US007213354B1

(12) United States Patent
Byrd et al.

(10) Patent No.: US 7,213,354 B1
(45) Date of Patent: May 8, 2007

(54) FOOTWEAR WITH DISPLAY ELEMENT

(75) Inventors: Bennett Clay Byrd, Clemmons, NC (US); George Peter Poulos, Greensboro, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 187 days.

(21) Appl. No.: 10/820,558

(22) Filed: Apr. 8, 2004
(Under 37 CFR 1.47)

Related U.S. Application Data

(60) Provisional application No. 60/461,308, filed on Apr. 8, 2003.

(51) Int. Cl.
*A43B 23/00* (2006.01)

(52) U.S. Cl. ..... 36/136; 36/25 R

(58) Field of Classification Search ..... 36/136, 36/112, 28, 29, 25 R, 31
See application file for complete search history.

(56) References Cited

U.S. PATENT DOCUMENTS

| | | | | |
|---|---|---|---|---|
| 2,720,713 | A | | 10/1955 | Schwartz et al. |
| 2,759,284 | A | | 8/1956 | Santisi |
| 3,082,556 | A | | 3/1963 | Schwartz et al. |
| 3,748,758 | A | | 7/1973 | Wilchusky |
| 4,050,167 | A | | 9/1977 | Senter |
| 4,347,673 | A | | 9/1982 | Svetlik |
| 4,697,362 | A | | 10/1987 | Wasserman |
| 4,712,314 | A | | 12/1987 | Sigoloff |
| 4,766,680 | A | | 8/1988 | Maciel et al. |
| 4,843,741 | A | | 7/1989 | Yung-Mao |
| 4,845,863 | A | | 7/1989 | Yung-Mao |
| 4,852,276 | A | | 8/1989 | Savoca et al. |
| 4,887,367 | A | | 12/1989 | Mackness et al. |
| 5,086,574 | A | * | 2/1992 | Bacchiocchi ..... 36/35 R |
| 5,152,081 | A | * | 10/1992 | Hallenbeck et al. ..... 36/28 |
| D330,627 | S | | 11/1992 | Frachey et al. |
| D330,628 | S | | 11/1992 | Frachey et al. |
| 5,331,753 | A | | 7/1994 | Rodibaugh |
| 5,363,570 | A | | 11/1994 | Allen et al. |
| 5,369,896 | A | * | 12/1994 | Frachey et al. ..... 36/29 |
| 5,402,588 | A | | 4/1995 | Graham et al. |
| 5,528,842 | A | | 6/1996 | Ricci et al. |
| 5,775,005 | A | | 7/1998 | McClelland |
| 5,815,949 | A | * | 10/1998 | Sessa ..... 36/3 B |
| 5,822,885 | A | | 10/1998 | Loverin |
| 5,839,211 | A | | 11/1998 | Pallera |
| 5,860,226 | A | | 1/1999 | Graham et al. |
| 5,983,529 | A | * | 11/1999 | Serna ..... 36/28 |
| 6,038,790 | A | * | 3/2000 | Pyle et al. ..... 36/30 R |
| 6,050,007 | A | | 4/2000 | Angelieri et al. |
| 6,119,371 | A | | 9/2000 | Goodwin et al. |
| 6,120,880 | A | * | 9/2000 | Crow ..... 428/167 |
| 6,176,025 | B1 | * | 1/2001 | Patterson et al. ..... 36/28 |
| 6,457,261 | B1 | | 10/2002 | Crary |

(Continued)

*Primary Examiner*—Marie Patterson
(74) *Attorney, Agent, or Firm*—Kilpatrick Stockton LLP

(57) ABSTRACT

An article of footwear includes an outsole, a midsole, an insole, and a display element having a shape and a thickness. The display element shape can be circular, oval, or other shape appropriate for display through a shoe outsole. The display element has a color, such as a color that coordinates with team colors of a sports team. A cut-out having substantially the same shape and thickness as the display element is formed in the midsole for receiving the display element. The outsole includes a transparent portion through which a display element can be viewed from the bottom of the outsole.

3 Claims, 6 Drawing Sheets

U.S. PATENT DOCUMENTS 6,539,646 B2 4/2003 Brooks et al.
6,711,836 B2 * 3/2004 Weiss ..... 36/136
2002/0050077 A1 5/2002 Wang et al.
2002/0088143 A1 7/2002 Brooks et al.
2003/0084595 A1 * 5/2003 Weiss ..... 36/83

* cited by examiner

FOOTWEAR WITH DISPLAY ELEMENT

CROSS-REFERENCE TO RELATED APPLICATIONS

This application claims priority to co-pending U.S. Provisional Patent Application No. 60/461,308, filed Apr. 8, 2003, which is incorporated herein in its entirety.

COPYRIGHT NOTIFICATION

A portion of the disclosure of this patent document and its attachments contain material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

FIELD OF THE INVENTION

The present invention relates to an article of footwear and in particular to footwear having a display element viewable through the outsole and methods of making such an article of footwear. Embodiments of the present invention are advantageous for providing footwear in which indicia and colors of a sports team can be viewed through defined portions of the outsole of a shoe.

BACKGROUND OF THE INVENTION

Athletic or other activewear shoes of a conventional construction generally have three or four separate parts. First, such shoes are provided with an outsole that is made of a durable material and that extends across the lower surface of the shoe. The outsole provides traction, protection, and a durable wear surface. A midsole is joined to the outsole to provide a cushioning layer to the wearer's foot. An insole is disposed between the midsole and the wearer's foot for additional cushioning. Usually, an upper formed of leather, synthetics, or other materials is joined to the midsole. The upper is designed to snugly and comfortably enclose the foot.

Conventional footwear designs provide decorations, embossed figures, and the like on the outer surface of the shoe soles. Such designs are generally worn off or degraded quickly after use of the footwear. Other footwear constructions utilize the insertion of an inset figure in a recessed area of the sole. While such figures maybe inset so as to be substantially flush with the walking surface of the sole, the figure design often wears off due to pressure of the foot against the shoe and walking or running surface. Also, the design can be obscured by mud and dirt. Other shoe constructions involve embedding plugs in recesses in the outsole of the shoe. Such plugs function to provide reduce skidding, for example, in an infant's shoe, or to promote sliding, such as in a bowling shoe. These plugs, however, provide little or no decorative effect.

Other conventional footwear soles provide an insert for a decorative effect. In such designs, a transparent or translucent window in an outsole allows viewing of the unique design aspects of an insert within the outsole of the shoe. For example, one footwear sole construction provides a decorative insert mounted within a single outer surface ply of the outsole protected by a clear plastic element. In another construction, a footwear sole includes two attached layers. The first layer has an integral display element and is at least semi-transparent such that the display element is observable through the first layer. Yet another design includes an outsole upper surface extending peripherally about the outsole having an aperture in the outsole upper surface. A display article is disposed within the aperture and is observable through a transparent outsole bottom surface.

Another shoe sole design has an outsole and a cushioning insert visible through a transparent window located in the sidewall of the sole. The window opening weakens the sidewall and can adversely affect the durability and resiliency of the sole. In another arrangement, a transparent window is recessed into the outsole to prevent scuffing or abrasion which could obscure the view through the window. However, the recessed window has the disadvantage of reducing the wear surface of the sole.

In yet another design, a transparent or translucent cleated insert is mounted within an outsole aperture to provide a cleated window forming a portion of the outsole wear surface. A cushioning insert is mounted on top of the cleated window within a pocket in the upper portion of the outsole, such that the inserts are visible through the window so that the wearer can better appreciate the shoe construction and its function. Another disadvantage of conventional decorative shoe sole inserts is that such inserts are mounted in or are integral with the outsole of the shoe and are not easily interchangeable. Moreover, shoe sole display inserts are often provided for their novelty or entertainment value, while purchasers of shoes also seek performance value in terms of both proper support of the shoes and durability.

A conventional athletic shoe includes a transparent or translucent sole having a bore extending at least half the length of the sole and a tubular light source inserted into the bore. While this type of athletic shoe design allows for display of a light source which may be interchangeable, the shoe does not provide for display of logo indicia or coordinating team colors through the bottom of an outsole.

Thus, there is a need to provide footwear having a display element viewable through the outsole such that the display element is easily interchangeable. There is a need to provide such footwear that have display elements that have a decorative effect, that provide good support to a wearer, and that are not susceptible to increased wear and tear. There is a need for such footwear in which indicia and colors of a sports team can be viewed through defined portions of the outsole of a shoe.

SUMMARY OF THE INVENTION

The present invention provides an article of footwear having a display element viewable through the outsole and methods of making such an article of footwear. Embodiments of the present invention are advantageous for providing footwear in which colors and indicia of a sports team can be viewed through defined portions of the outsole of a shoe.

In an embodiment, an article of footwear includes an outsole, a midsole, and an insole. The footwear includes a display element having a shape and a thickness. The display element shape can be circular, oval, or other shape appropriate for display through a shoe outsole. The display element has a color, such as a color that coordinates with team colors of a sports team. In embodiments, the display element can include logo indicia, for example, a team mascot logo or a trademarked sports team logo.

In embodiments, a cut-out is formed in the midsole for receiving the display element. The display element has substantially the same shape and thickness as the midsole cut-out. In embodiments, a cut-out is formed in both the midsole and the insole and both cut-outs are aligned with each other. Each cut-out has substantially the same shape as the display element for fittingly receiving the display element. The combined thickness of the midsole cut-out and the insole cut-out is substantially the same as the thickness of the display element. A display element is inserted into either or both cut-outs, depending on the decorative effect desired.

In embodiments of the present invention, a display element has substantially the same dimensions as a cut-out into which the display element is inserted. As such, the display element fits snugly in the cut-out, and is further supported in the cut-out by the outsole adjacent to the bottom of the display element and the pressure of a wearer's foot against the top of the display element. In addition, the top of a display element snugly inserted into a midsole cut-out can be supported in position by the presence of an insole on top of the display element.

The outsole includes a transparent portion through which a display element can be viewed from the outsole. In particular embodiments, a display element can be viewed from only the bottom of the outsole so that the display element can be viewed only when the shoe is raised. The midsole cut-out, display element, and outsole transparent portion can be located in the heel portion of the outsole or in the forward portion of the outsole. In embodiments, the outsole transparent portion is located in both the heel portion and the forward portion. Alternative, the entire outsole is transparent. When the display element is inserted into the cut-out in the midsole and/or insole, the display element is viewable through the transparent portion of the outsole.

In addition to an outsole, a midsole, a an insole, a display element, and an outsole transparent portion, an article of footwear of the present invention includes an upper attached to the sole and defining a volume for enclosing a wearer's foot.

In embodiments of the present invention, an article of footwear includes a plurality of interchangeable display elements. The display elements can be interchanged in various combinations to coordinate with a school or sports team's colors and/or logo. For example, if a school's colors are orange and purple, an orange display element can be used when the team is dressed in predominantly orange uniforms. When the team is dressed in predominantly purple uniforms, purple display elements can be inserted into the cut-out(s). Alternatively, when the team is dressed in orange uniforms, purple display elements can be easily inserted into the cut-out(s) as a contrasting color. Such interchangeable display elements are particularly useful for cheerleading shoes.

In embodiments of an article of footwear of the present invention, the shoe sole is formed from a moldable material. The moldable material can be thermoplastic and/or rubber. The midsole can be formed of a resiliently compressible material, such as a foam material. In some embodiments, the midsole foam material is ethylene vinyl acetate (EVA) or polyurethane, which compress resiliently under an applied load and dampen to provide cushioning. The outsole is preferably formed of a wear-resistant material, such as a carbon-black rubber compound.

Embodiments of the present invention include methods of making an article of footwear. One such method includes providing an article of footwear having an outsole, a midsole, and a an insole. The footwear includes a display element having a shape and a thickness. A cut-out having substantially the same shape as the display element is formed in the midsole for receiving the display element. At least a portion of the outsole is formed from a transparent material. The display element is interchangeably inserted into the cut-out. An upper defining a volume for enclosing a wearer's foot is attached to the shoe sole. When the display element is inserted into the cut-out in the midsole, the display element is viewable through the transparent portion of the outsole.

Other embodiments of a method include interchanging a plurality of the display elements. The display elements have a shape, for example, a circular shape or an oval shape. The display elements have a color, preferably a color that coordinates with team colors of a sports team. The display elements can further include logo indicia.

The thickness of the display element is the same as the thickness of the mid-sole so that the display element provides proper support to a wearer's foot. In embodiments, an article of footwear has a cut-out in the midsole and the insole, and both cut-outs are aligned. Both cut-outs have substantially the same shape as the display element for receiving the display element. The thickness of the display element is the same as the combined thicknesses of the mid-sole and the insole the display element provides proper support to a wearer's foot.

The outsole includes a transparent portion through which a display element can be viewed from the bottom of the outsole. The outsole transparent portion can be located in the heel portion of the outsole or in the forward portion of the outsole. In embodiments, the outsole transparent portion is located in both the heel portion and the forward portion. Alternative, the entire outsole is transparent. When the display element is inserted into the cut-out in the midsole and/or insole, the display element is viewable through the transparent portion of the outsole.

Features of footwear with a display element viewable through the outsole and methods of making such footwear of the present invention may be accomplished singularly, or in combination, in one or more of the embodiments of the present invention. As will be appreciated by those of ordinary skill in the art, the present invention has wide utility in a number of applications as illustrated by the variety of features and advantages discussed below.

Footwear with a display element viewable through the outsole and methods of making such footwear of the present invention provides numerous advantages over prior footwear and methods for making the footwear. For example, the present invention advantageously provides footwear having a display element viewable through the outsole such that the display element is easily interchangeable.

Another advantage is that the present invention provides such footwear that have display elements that have a decorative effect.

Another advantage is that the present invention provides a non-reduced wear surface of the sole and provide good support to a wearer.

Another advantage is that the present invention provides such footwear having normal durability and resilience and that are not susceptible to increased wear and tear.

Another advantage is that the present invention provides such footwear in which indicia and colors of a sports team can be viewed through defined portions of the outsole of a shoe.

As will be realized by those of skill in the art, many different embodiments of footwear with a display element viewable through the outsole and methods of making such footwear according to the present invention are possible. Additional uses, objects, advantages, and novel features of the invention are set forth in the detailed description that follows and will become more apparent to those skilled in the art upon examination of the following or by practice of the invention.

DETAILED DESCRIPTION

Figure 1:
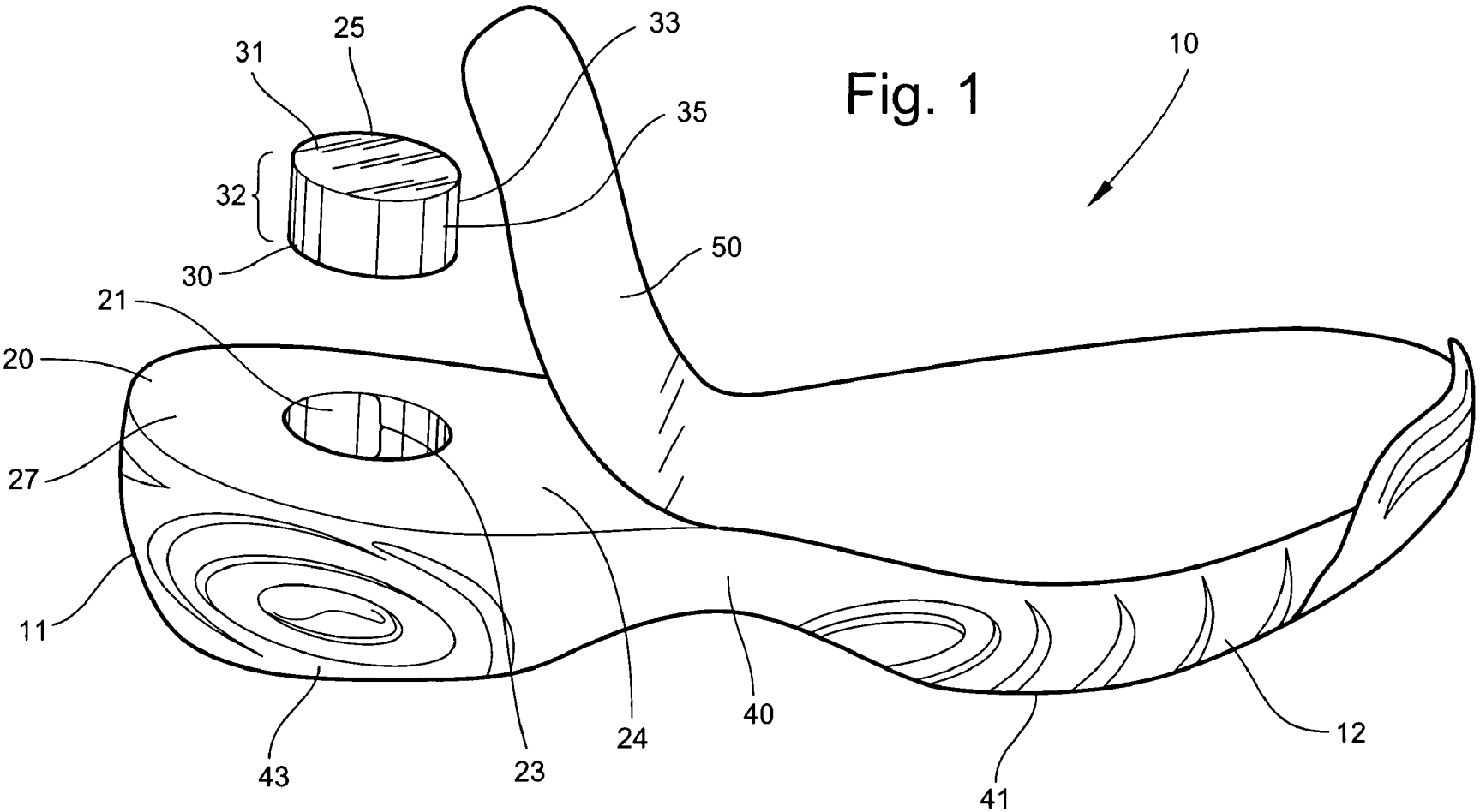
FIG. 1 is a side perspective view of a shoe sole showing an insole lifted away from a midsole, a midsole cut-out, and a display element viewable through the outsole in an embodiment of the present invention.
Figure 2:
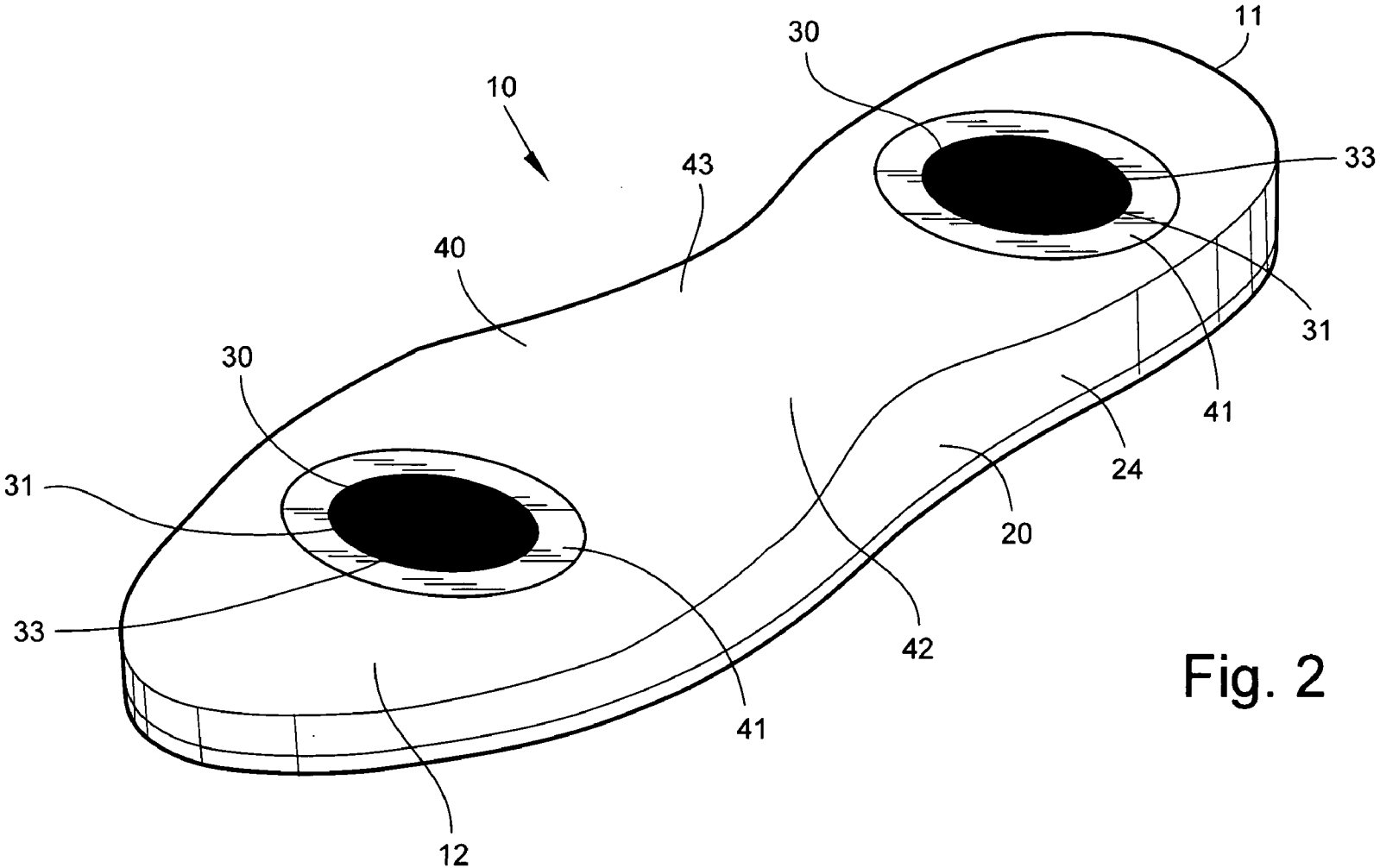
FIG. 2 is a bottom perspective view of a right-foot shoe sole with a display element viewable through the heel and the forward portion of the outsole in an embodiment of the present invention.
Figure 3:
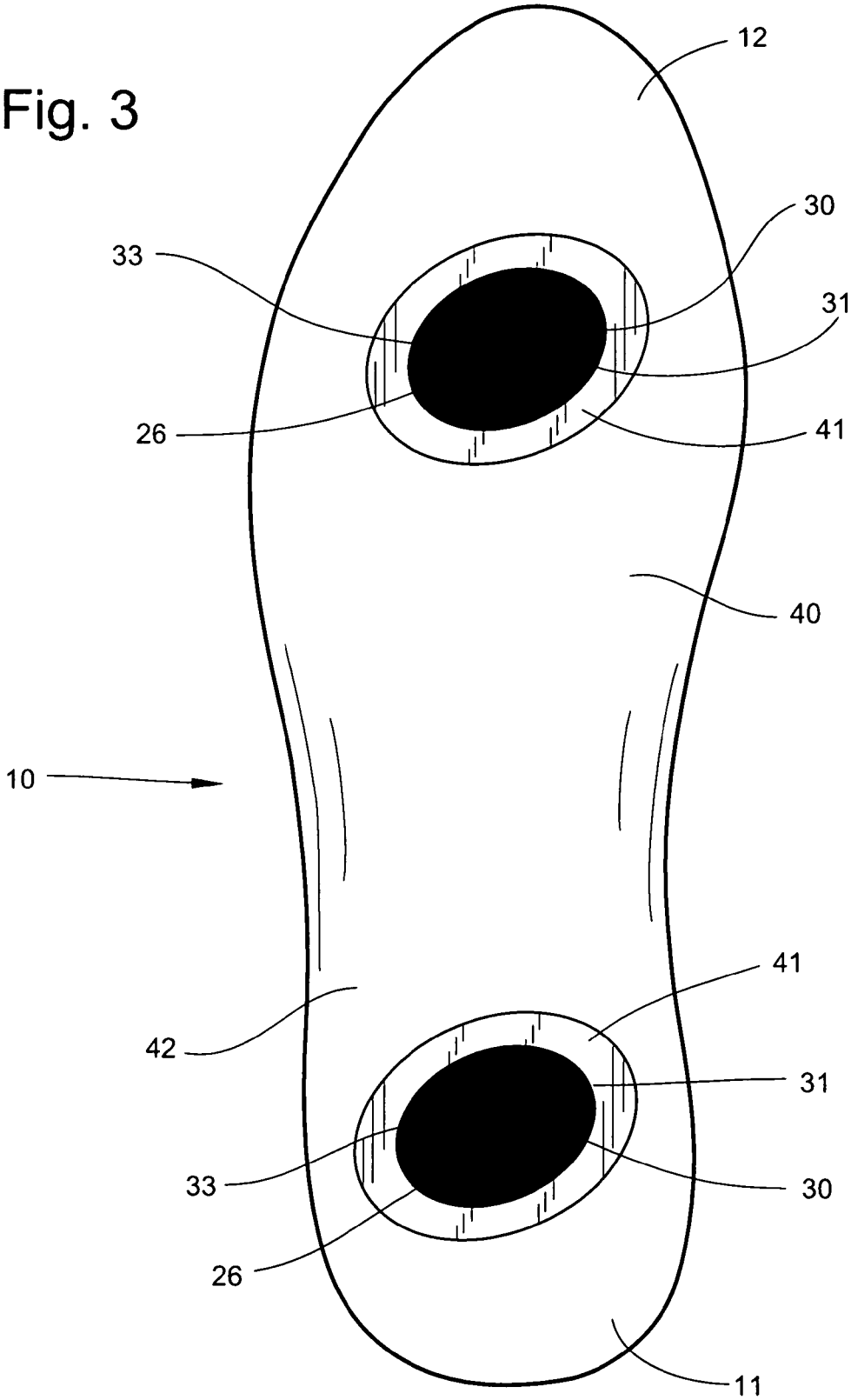
FIG. 3 is a bottom view of the embodiment of a right-foot shoe sole in FIG. 2, having a display element viewable through the heel and the forward portion of the outsole.

In embodiments of the present invention, an article of footwear includes a display element viewable through an outsole and methods of making such an article of footwear. FIGS. 1–7 show such embodiments. For example, in the embodiment in FIG. 1, an article of footwear 10 comprises a midsole 20 having a cut-out 21 formed in the midsole 20. The midsole cut-out 21 has a shape 22 and a thickness 23. In the embodiment shown in FIG. 1, the midsole is made of an opaque material 24. A display element 30 has substantially the same shape 31 and thickness 32 as the midsole cut-out 21 so as to be fittingly insertable into the midsole cut-out 21. An outsole 40 has a transparent portion 41 (as shown in FIGS. 2–5) overlying the midsole cut-out 21. When the display element 30 is inserted into the midsole cut-out 21, the display element 30 is viewable through the transparent portion 41 of the outsole 40. In embodiments, the display element 30 is viewable from the bottom 42 of the outsole 40 (as shown in FIGS. 2–5).

While a right-foot shoe is depicted in FIG. 1, it is to be understood that similar elements are also present in embodiments of a left-foot shoe. That is, all elements of the present invention may apply to embodiments of either right-foot and/or left-foot footwear.

Figure 4:
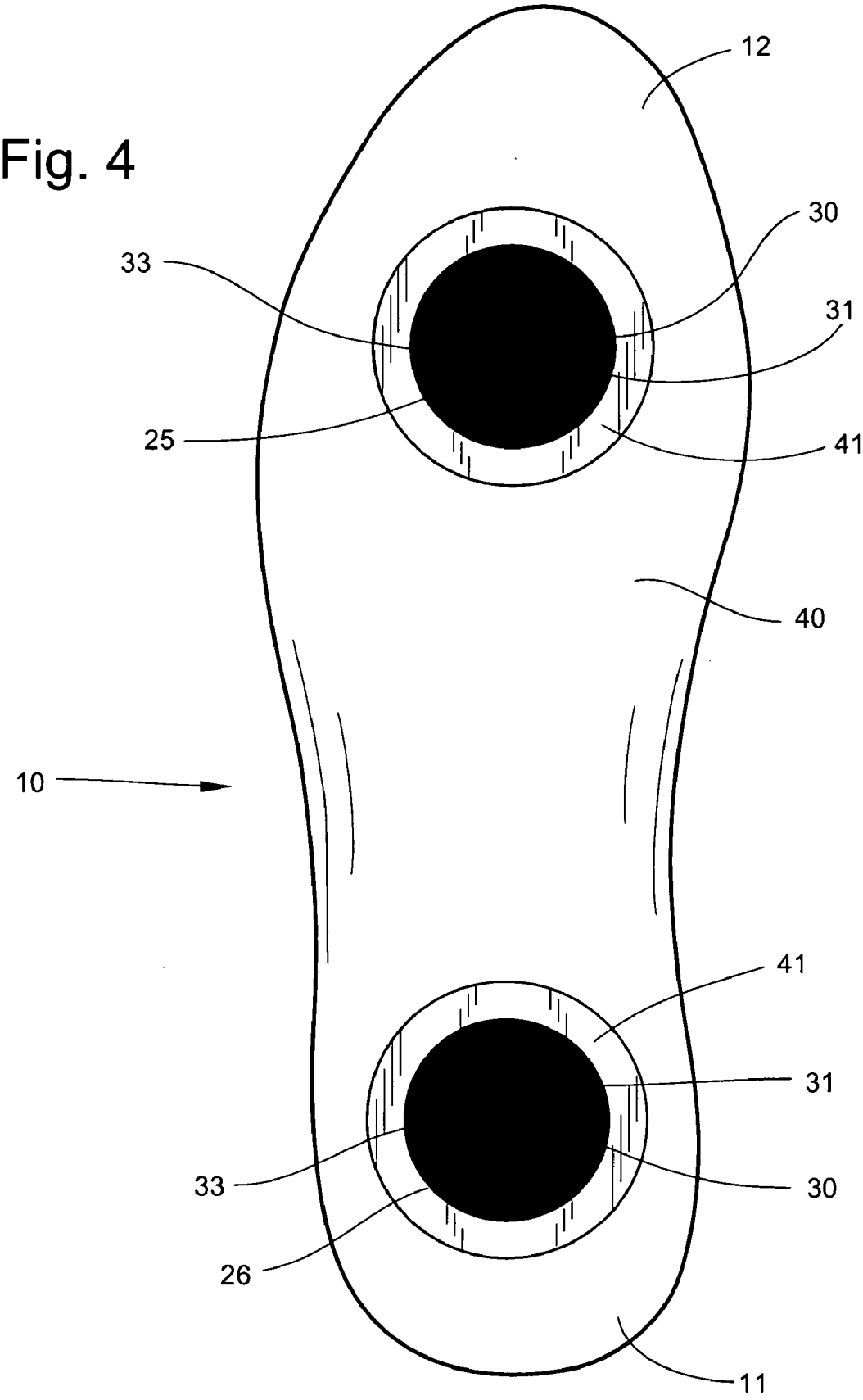
FIG. 4 is a bottom view of a right-foot shoe outsole having a circular display element viewable through the heel and through the forward portion of the outsole in an embodiment of the present invention.

In the embodiments shown in FIGS. 1 and 4, the shape 22 of the midsole cut-out 21 and the display element 30 is circular 25. In the embodiments shown in FIGS. 2, 3, and 5, the shape 22 of the midsole cut-out 21 and the display element 30 is oval 26. As shown in FIGS. 2–5 and 7, the midsole cut-out 21 is located in both the heel 11 and the forward portion 12 of the outsole 40 of the article of footwear 10. In embodiments, such as shown in FIG. 1, the midsole cut-out 21 is located in only the heel 11 of the article of footwear 10. In other embodiments (not shown), the midsole cut-out 21 is located only in the forward portion 12 of the article of footwear 10.

In embodiments of the present invention, the article of footwear 10 includes a plurality of interchangeable display elements 30. For example, display elements 30 can comprise one of various desired colors 33, as shown in FIGS. 2–5. The desired color 33 can be a color 33 coordinated with team colors of a sports team. As such, a plurality of display elements 30 are interchangeable in midsole cut-outs 21 such that display elements 30 having colors 33 of a particular school or team can be viewable through the bottom 42 of an outsole 40 of a shoe. By way of illustration, when a team wears particular colors for a "home" game, one color 33 of display elements 30 that coordinates with the "home" color can be displayed through the outsoles 40 of team shoes. When "away" game colors are worn, display elements 30 having colors 33 that coordinate with the "away" game colors can be displayed through the outsoles 40 of team shoes.

Figure 5:
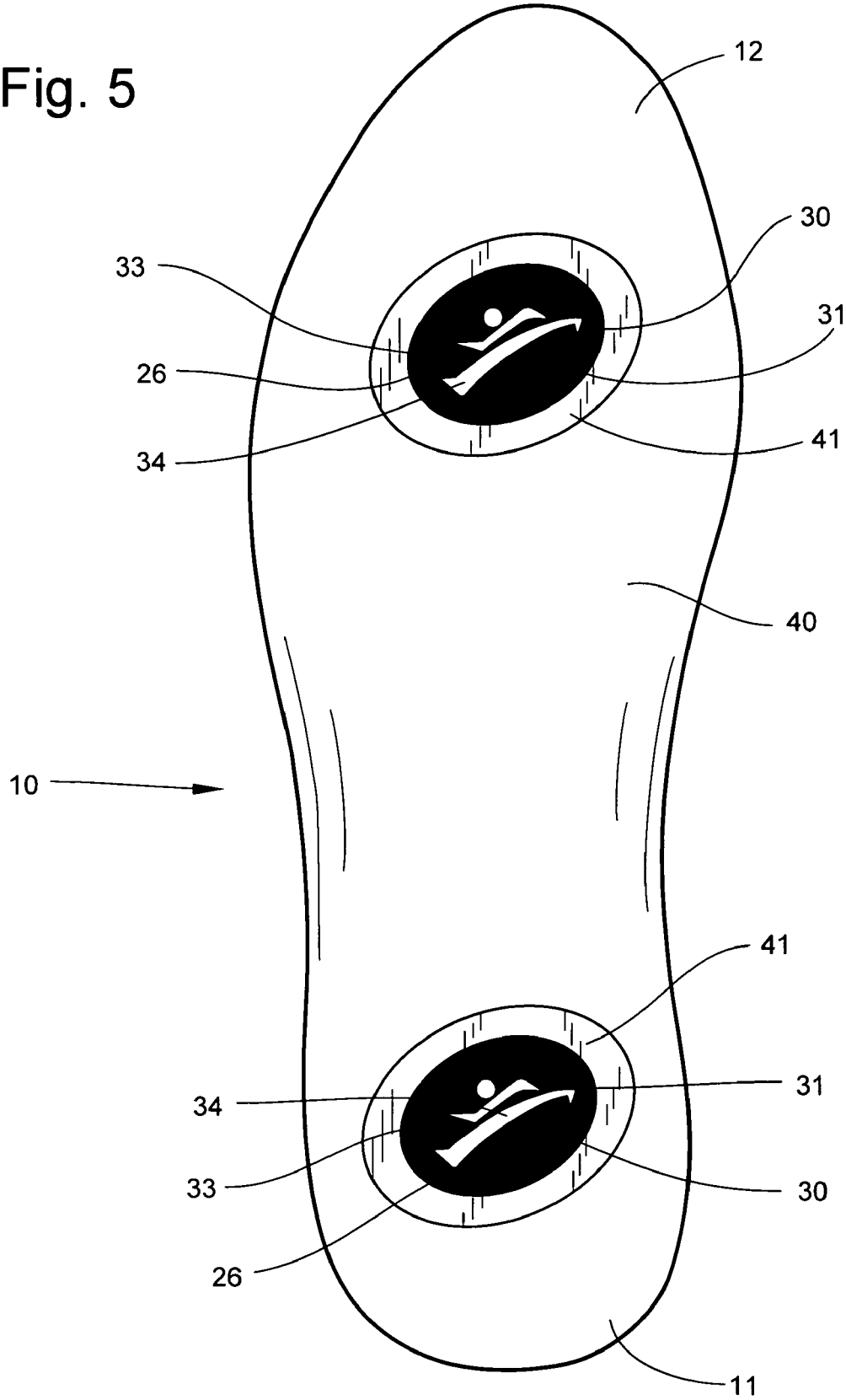
FIG. 5 is a bottom view of a right-foot shoe outsole having an oval display element viewable through the heel and through the forward portion of the outsole in another embodiment of the present invention.

In addition, in another embodiment, midsole cut-outs 21 for a left-foot shoe and a right-foot shoe have the same dimensions. Accordingly, a display element 30 that has substantially the same dimensions as the left-foot and right-foot shoe midsole cut-outs 21 can be used in either left-foot or right-foot shoe. As such, the display element 30 can be used interchangeably between the left-foot and right-foot shoes. Embodiments of the present invention can include display elements 30 that include logo indicia 34, as shown in FIG. 5. In other embodiments, logo indicia 34 can be embedded in the transparent portion 41 of the outsole 40, such that the logo indicia 34 are visible in front of the display element 30.

As shown in the embodiment in FIG. 1, the article of footwear 10 can an insole 50 having a cut-out (not shown) having substantially the same shape as the midsole cut-out 21 and the display element 30 and aligned with the midsole cut-out 21 for fittingly receiving the display element 30 through the insole cut-out and into the midsole cut-out 21. In such an embodiment, the display element 30 thickness 32 is substantially the same as the combined thicknesses of the insole cut-out and the midsole cut-out 21.

In embodiments of the present invention, the midsole 20 and/or the display element 30 can be made from a resiliently compressible material 27, 35, respectively. For example, the display element 30 can comprise a foam material or a gel pad. The outsole 40 can be made from a wear-resistant material. The transparent portion 41 of outsole 40 can be based on either thermoplastic or thermosetting resin systems and can be formulated from any elastomeric material that can be made into a clear product with a combination of sufficient strength, flexibility, and durability. Suitable elastomeric materials include synthetic elastomers based on homo and copolymer systems such as polycondensation polymers (for example, polyurethanes), ethylene-propylene based copolymers (for example, EPDM), other synthetic rubber materials (for example, SBR or neoprene), vinyl-based polymers (for example, polyvinyl chloride), polyacrylate copolymers, and the like.

Figure 6:
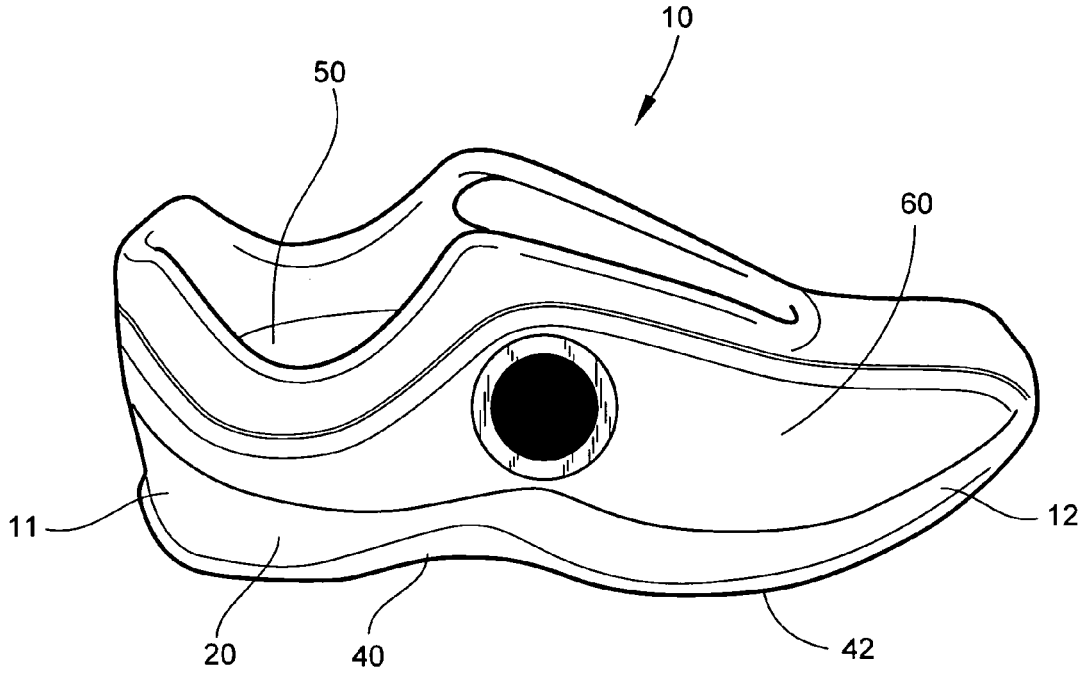
FIG. 6 is a side perspective view of a right-foot shoe shown in FIG. 7, illustrating an upper attached to the midsole and outsole and having a display element viewable through the heel and the forward portion of the outsole in an embodiment of the present invention.
Figure 7:
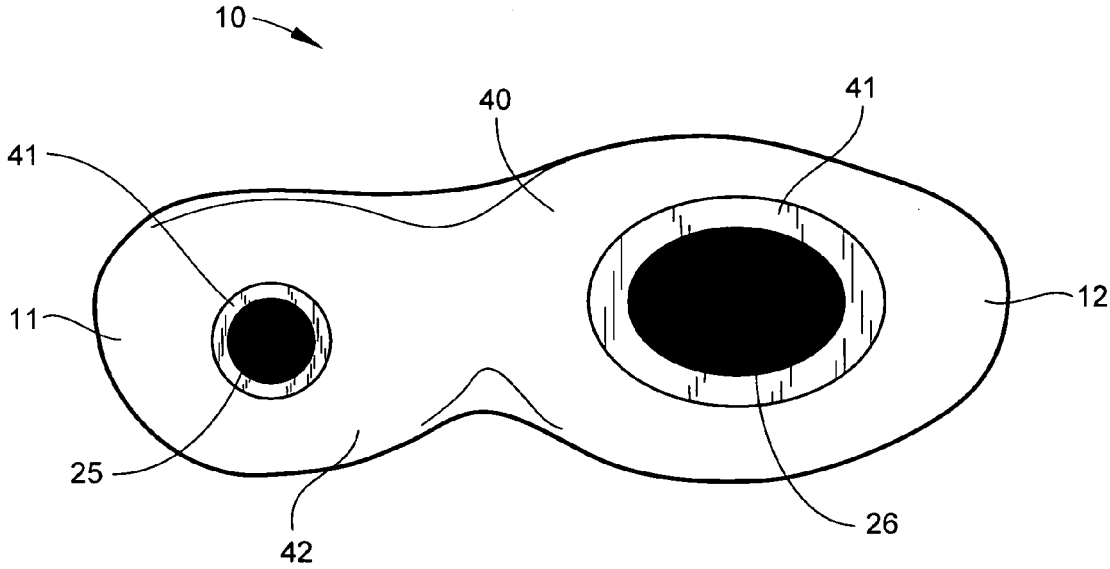
FIG. 7 is a bottom view of the outsole of the shoe shown in FIG. 6, having a display element viewable through the heel and through the forward portion of the outsole.

As shown in FIG. 6, embodiments of the article of footwear 10 can include an upper 60 attached to the midsole 20 and outsole 40 and defining a volume for enclosing a wearer's foot. In embodiments, a sock liner of an upper 60 is attached to the upper 60, for example by sewing, such that lifting the insole 50 to remove a display element 30 from and/or place a display element 30 into the midsole cut-out 21 is unimpeded by the sock liner. In embodiments of an article of footwear 10 of the present invention, the sock liner and/or other structures, including the insole 50, can include a moisture-management material. One such moisture-management material is Drilex, available commercially from the Faytex Corporation of Weymouth, Mass.

In another embodiment, the article of footwear 10 includes a midsole 20 having a cut-out 21 formed in the midsole 20, the cut-out 21 having a shape 22 and a thickness 23. A midsole insert (not shown) similar to display insert 30 has substantially the same shape as the midsole cut-out 21 so as to be fittingly insertable into the midsole cutout 21 and a thickness less than the thickness 23 of the midsole cut-out 21. The display element 30 has substantially the same shape 31 as the midsole cut-out 21 so as to be fittingly insertable into the midsole cutout 21 and a thickness 32 less than the thickness 23 of the midsole cut-out 21. When the display element 30 is inserted into the midsole cut-out 21 and disposed between the midsole insert (not shown) and the outsole 40, the midsole insert thickness and the display element thickness 32 together are substantially the same as the midsole cut-out 21 thickness 23. The outsole 40 has a transparent portion 41 overlying the midsole cut-out 21. In this arrangement, the display element 30 is viewable through the transparent portion 41 of the outsole 40. In such an embodiment, the midsole insert can comprise a cushioning material or a non-cushioning material.

Embodiments of the present invention include methods of making an article of footwear having one or more display element(s) viewable through the bottom of a shoe outsole. One such embodiment of a method includes forming a cut-out 21 in a midsole 20 of the footwear 10, the cut-out 21 having a shape 22 and a thickness 23. A display element 30 has substantially the same shape 31 and thickness 32 as the midsole cut-out 21 for fittingly inserting the display element 30 into the midsole cut-out 21. A transparent material is utilized to form a transparent portion 41 of an outsole 40 of the footwear 10 overlying the midsole cut-out 21. The display element 30 is then inserted into the midsole cut-out 21 so that the display element 30 is viewable through the transparent portion 41 of the outsole 40. Such an embodiment can include attaching the midsole 20 and outsole 40 to an upper 60 to define a volume for enclosing a wearer's foot.

In other embodiments of a method, a plurality of the display elements 30 is provided. Each of the plurality of display elements 30 has a color 33 or indicia. The display elements 30 can be interchanged in one or more of the midsole cut-outs 21.

In other embodiments of a method, a cut-out (not shown) is made in the insole 50 of the footwear 10. The insole 50 cut-out has substantially the same shape as the midsole cut-out 21 and the display element 30, and is aligned with the midsole cut-out 21 for fittingly receiving the display element 30 through the insole cut-out and into the midsole cut-out 21.

In yet other embodiments of a method, a midsole insert (not shown) is provided. The midsole insert has substantially the same shape as the midsole cut-out 21 for fittingly inserting into the midsole cutout 21. The midsole insert has a thickness less than the thickness 23 of the midsole cut-out 21. The display element 30 thickness 32 is less than the thickness 23 of the midsole cut-out 21. The display element 30 is inserted into the midsole cut-out 21, and disposed between the midsole insert and the outsole 40. In this arrangement, the midsole insert thickness and the display element 30 thickness 32 together are substantially the same as the midsole cut-out 21 thickness 23. The display element 30 is viewable through the transparent portion 41 of the outsole 40.

Although the present invention has been described with reference to particular embodiments, it should be recognized that these embodiments are merely illustrative of the principles of the present invention. Those of ordinary skill in the art will appreciate that footwear with a display element viewable through the outsole and methods of making such footwear of the present invention may be constructed and implemented in other ways and embodiments. Accordingly, the description herein should not be read as limiting the present invention, as other embodiments also fall within the scope of the present invention.

What is claimed is:

1. An article of footwear, comprising:

a midsole having a cut-out formed in the midsole, the cut-out having a shape and a thickness;

a midsole insert having substantially the same shape as the midsole cut-out so as to be fittingly insertable into the midsole cutout and a thickness less than the thickness of the midsole cut-out;

a display element having substantially the same shape as the midsole cut-out so as to be fittingly insertable into the midsole cutout and a thickness less than the thickness of the midsole cut-out; and an outsole having a transparent portion overlying the midsole cut-out;

wherein when the display element is inserted into the midsole cut-out and disposed between the midsole insert and the outsole, the midsole insert thickness and the display element thickness together are substantially the same as the midsole cut-out thickness, and wherein the display element is viewable through the transparent portion of the outsole.

2. The article of footwear of claim 1, wherein the midsole insert comprises a cushioning material.

3. The article of footwear of claim 1, wherein the midsole insert comprises a non-cushioning material.

* * * * *